US006958005B1

(12) United States Patent
Charatan

(10) Patent No.: US 6,958,005 B1
(45) Date of Patent: Oct. 25, 2005

(54) POLISHING PAD CONDITIONING SYSTEM

(75) Inventor: Robert Charatan, Portland, OR (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/813,294

(22) Filed: Mar. 30, 2004

(51) Int. Cl.[7] ..... B24B 1/00
(52) U.S. Cl. ..... 451/56; 451/443; 451/36; 451/446
(58) Field of Search ..... 451/56, 443, 287, 451/36, 446, 285, 41

(56) References Cited

U.S. PATENT DOCUMENTS

| | | | | |
|---|---|---|---|---|
| 5,782,675 | A * | 7/1998 | Southwick | 451/56 |
| 5,857,899 | A | 1/1999 | Volodarsky et al. | 451/72 |
| 5,913,714 | A | 6/1999 | Volodarsky et al. | 451/41 |
| 5,913,715 | A * | 6/1999 | Kirchner et al. | 451/56 |
| 6,053,801 | A * | 4/2000 | Pinson et al. | 451/56 |
| 6,086,460 | A | 7/2000 | Labunsky et al. | 451/56 |
| 6,190,236 | B1 * | 2/2001 | Drill | 451/41 |
| 6,200,207 | B1 * | 3/2001 | Hsu | 451/443 |
| 6,241,587 | B1 * | 6/2001 | Drill et al. | 451/56 |
| 6,283,840 | B1 * | 9/2001 | Huey | 451/288 |
| 6,306,019 | B1 | 10/2001 | Finkelman | 451/56 |
| 6,306,022 | B1 * | 10/2001 | Tung et al. | 451/290 |
| 6,328,637 | B1 | 12/2001 | Labunsky et al. | 451/56 |
| 6,336,845 | B1 | 1/2002 | Engdahl et al. | 451/41 |
| 6,361,414 | B1 | 3/2002 | Ravkin et al. | 451/56 |
| 6,371,838 | B1 * | 4/2002 | Holzapfel | 451/72 |
| 6,390,902 | B1 * | 5/2002 | Chang et al. | 451/285 |
| 6,530,827 | B2 * | 3/2003 | Mitsuhashi | 451/72 |
| 6,554,688 | B2 | 4/2003 | Lacy | 451/56 |
| 6,626,743 | B1 | 9/2003 | Boyd | 451/56 |
| 6,645,046 | B1 | 11/2003 | Vogtmann et al. | 451/8 |
| 6,648,740 | B2 * | 11/2003 | Perlov et al. | 451/288 |
| 6,695,684 | B2 * | 2/2004 | Park et al. | 451/56 |
| 6,740,169 | B2 * | 5/2004 | Cho et al. | 134/3 |
| 6,752,697 | B1 * | 6/2004 | Stoeckgen et al. | 451/56 |
| 6,773,332 | B2 * | 8/2004 | Moore | 451/5 |

* cited by examiner

*Primary Examiner*—Eileen P. Morgan
(74) *Attorney, Agent, or Firm*—Brinks Hofer Gilson & Lione

(57) ABSTRACT

A pad conditioning system for conditioning a polishing pad in conjunction with a workpiece polishing operation includes a pad conditioning head coupled with a positioning unit. The pad conditioning head includes a plurality of abrasive particles protruding from a surface of the pad conditioning head. The positioning unit is configured to move the surface into contact with a polishing pad. The pad conditioning system also includes a liquid supply nozzle. The liquid supply nozzle is configured to selectively discharge liquid proximate to the abrasive particles that are in contact with the polishing pad to minimize frictional wear of the abrasive particles.

28 Claims, 5 Drawing Sheets

POLISHING PAD CONDITIONING SYSTEM

FIELD OF THE INVENTION

The present invention relates to planarization using a chemical mechanical planarization technique that involves a polishing pad. More particularly, the present invention relates to a polishing pad conditioning system used to condition the polishing pad in conjunction with the polishing of a workpiece, such as a semiconductor wafer.

BACKGROUND

Semiconductor wafers are typically fabricated with multiple copies of a desired integrated circuit design that will later be separated and made into individual chips. Wafers are commonly constructed in layers, where a portion of a circuit is created on a layer and conductive vias are created to electrically connect the circuit to other layers. After each layer of the circuit is etched on the wafer, an oxide layer is put down allowing the vias to pass through but covering the rest of the previous circuit layer. In one instance, each layer of the circuit can create or add unevenness to the wafer that is typically smoothed before generating the next circuit layer.

Chemical mechanical planarization (CMP) techniques can be used to planarize the raw wafer and each layer of material added thereafter. Available CMP systems are commonly called wafer polishers. Often such a wafer polisher will include a rotating wafer carrier head. The wafer carrier head may bring the wafer into contact with a polishing pad. In a rotary CMP system, the polishing pad may be circularly rotated in the plane of the wafer surface to be planarized. A polishing fluid, such as a chemical polishing agent or slurry containing micro abrasives may be applied to the polishing surface to polish the wafer. The wafer is pressed against the rotating polishing pad and is rotated to polish and planarize the wafer. Another CMP technique uses a linear polisher. Instead of a rotating pad, a moving belt is used to linearly move the polishing pad across the rotating wafer surface.

As the wafer is polished, the polishing pad also becomes smoother or planarized. Additionally, residue from the slurry and/or reaction byproducts may influence the performance of the pad conditioner. The consistency in polishing multiple wafers is an important aspect of planarization of wafers. To maintain the surface of the polishing pad at a consistent level of abrasiveness, a pad conditioner may be used. The pad conditioner may similarly be pressed into the moving polishing pad. The surface of the pad conditioner that is pressed into the polishing pad may include an abrasive substance, such as diamond grit, to scratch or roughen the surface of the polishing pad.

During the process of conditioning the polishing pad, undesirable residue may be generated that can vary the consistency of wafer polishing. In addition, localized heating may occur in the area where the pad conditioner is conditioning the polishing pad. The localized heating may cause undesirable melting of the polishing pad and/or localized drying of the polishing pad that may affect the consistency of wafer polishing. Accordingly, there is a need for systems and methods for controlling the residue and localized heating associated with conditioning a polishing pad.

BRIEF SUMMARY

The present invention includes a pad conditioning system. The pad conditioning system includes a pad conditioning head coupled with a positioning unit. The positioning unit may be configured to maneuver the pad conditioning head into contact with a polishing pad. In addition, the positioning unit may be configured to move the pad conditioning head around on the surface of the polishing pad in a determined pattern to condition the surface of the polishing pad. The determined pattern may correspond to the areas of the conditioning pad being used to planarize a workpiece.

The pad conditioning head includes a conditioning element. The conditioning element may be a flat or domed generally circular disc that includes a surface having a plurality of abrasive particles. The abrasive particles may be distributed on the surface and extend outwardly from the surface. The surface of the conditioning element may be pressed into the surface of a polishing pad by the positioning unit to condition, or roughen, the polishing pad with the abrasive particles.

The pad conditioning system also includes a liquid supply line. The liquid supply line may be routed through the pad conditioning head. A liquid supply nozzle may be included as part of the liquid supply line. The liquid supply nozzle may be positioned proximate to the conditioning element. More specifically, one or more of the liquid supply nozzles may each be disposed in one or more apertures formed in the surface of the conditioning element. The one or more apertures may be formed to be between the abrasive particles on the surface. Alternatively, one or more of the liquid supply nozzles may be mounted proximate to the periphery of the conditioning element. In either configuration, the liquid supply nozzle is configured to discharge liquid between the conditioning element and the polishing pad to minimize frictional wear of the abrasive particles on the surface of the conditioning element during the polishing operation. In addition, the localized discharge of liquid may provide cooling of the surface of the polishing pad. Residue generated by the conditioning operation may also be minimized by rinsing/cleaning the conditioning element and the polishing pad with the liquid.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF SEVERAL VIEWS OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

The present invention includes a polishing pad conditioning system. The polishing pad conditioning system may maintain the condition of a surface of a polishing pad during polishing of a workpiece. During the polishing process, a number of workpieces, such as semiconductors, may be sequentially polished with the polishing pad. Each of the workpieces is pressed into a moving polishing pad to planarize the surface of the workpiece. The pad conditioning system is used to condition the polishing pad to sustain a surface of the polishing pad in a relatively constant state. The consistency of the surface of the polishing pad provides repeatability so that each of the work pieces may be more consistently planarized. Liquid may be applied by the pad conditioning system to minimize and/or control residue generated during the polishing pad conditioning process. The liquid may also minimize and/or control residue that includes the polishing liquid and or/reaction byproducts from the polishing of a workpiece. In addition, the liquid that is locally applied by the polishing pad system may reduce localized drying of the polishing pad and/or localized heating of the polishing pad resulting from the conditioning operation.

Figure 1:
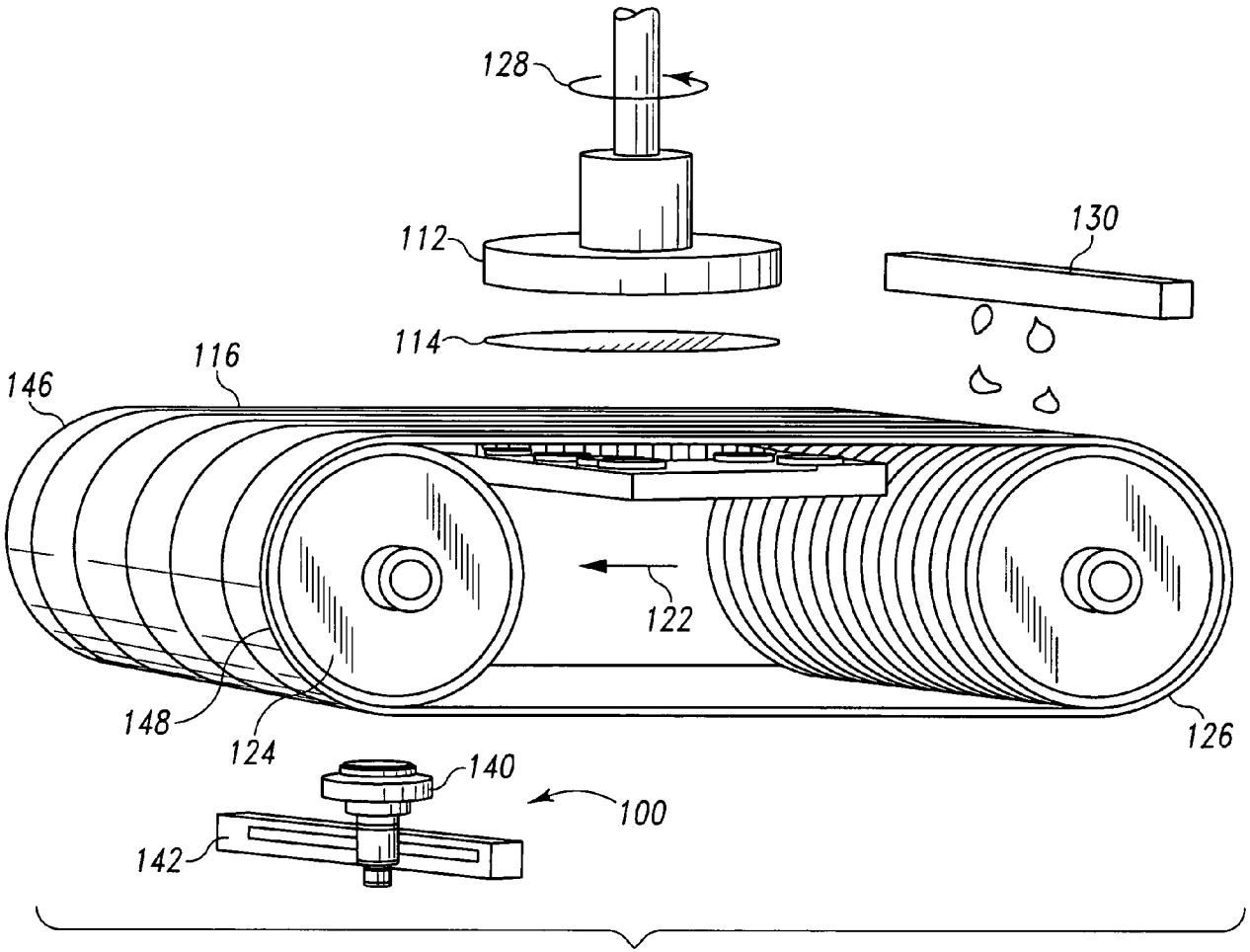
FIG. 1 is a front view of a chemical mechanical planarization machine.

FIG. 1 is a perspective view of an example chemical mechanical planarization (CMP) machine that includes a pad conditioning system 100. The illustrated CMP machine is a semiconductor wafer polishing machine. The semiconductor wafer polishing machine may be used in interlayer dielectric (ILD) processing, intermetallic dielectric (IMD) processing, pre-metal dielectric (PMD) processing, copper (Cu) processing or any other form of planarization processes for semiconductor wafers. Other objects such as, for example, quartz crystals, ceramic elements, lenses, glass plates and other work pieces may also be planarized and polished by the CMP machine. One example CMP machine uses linear planarization technology and may be part of a TERES™ Chemical Mechanical Planarization (CMP) system available from Lam Research Corporation located in Fremont, Calif. In other examples any other form of chemical mechanical planarization (CMP) such as rotary, orbital, etc. may be used with the pad conditioning system 100.

The example CMP machine also includes a wafer carrier 112 that may have a semiconductor wafer 114 detachably coupled with the wafer carrier 112 by a vacuum or other similar mechanism. The wafer carrier 112 may be maneuvered to place the semiconductor wafer 114 in pressurized contact with a polishing pad 116. In the illustrated example, the polishing pad 116 is a continuous belt, however, in other examples of CMP machines, other forms of polishing pads, such as a rotary polishing pad may be employed. The illustrated polishing pad 116 represents an endless polishing surface that is operable to move horizontally in the direction indicated by arrow 122. The polishing pad 116 may be wrapped around a first roller 124 and a second roller 126. The first or second roller 124 or 126 may be rotated with a roller motor (not shown) at a determined speed.

During polishing, the first and second rollers 124 and 126 may rotate to move the polishing pad 116 linearly against the semiconductor wafer 114 while the wafer carrier 112 may also be rotated as illustrated by arrow 128. A slurry dispenser 130 may drip or discharge a polishing slurry onto the polishing pad 116 upstream of the wafer carrier 112 as the polishing pad 116 moves. The semiconductor wafer 114 may be pressed into the surface of the rotating polishing pad 116, while the polishing pad 116 may be supported opposite the semiconductor wafer 114 by a backing support (not shown), such as an air bearing generated with a platen. In other examples, any other form of structure or device, such as a roller, a smooth supported surface, etc. may be used for the backing support.

The pad conditioning system 100 may be positioned downstream of the wafer carrier 112 to be selectively brought into contact with the surface of the polishing pad 116. The illustrated pad conditioning system 100 is positioned adjacent the surface of the polishing pad 116 on the side opposite the wafer carrier 112 at the bottom of the first roller 124. In another example, the pad conditioning system 100 may be positioned below the second roller 126 adjacent the surface of the polishing pad 116. In still other examples, the pad conditioning system 100 may be positioned anywhere else adjacent to the surface of the polishing pad 116. If the pad conditioning system 100 is positioned to contact the surface of the polishing pad 116 where the polishing pad 116 is unsupported, a backing support may be used.

The pad conditioning system 100 includes a pad conditioning head 140 coupled with a positioning unit 142. The positioning unit 142 may be a lineal device and/or a radial device that include hinges, servo motors, hydraulics or any other mechanism(s) that enables lateral, vertical and/or rotational movement of the pad conditioning head 140.

During operation, the pad conditioning head 140 may be moved into contact with the surface of the rotating polishing pad 116. A determined amount of down force may be applied by the positioning unit 142 to the pad conditioning head 140 to condition (or roughen) the polishing pad 116. As used herein, the terms "condition", "conditioning" or "conditioned" refers to the result of physical contact between the pad conditioning head 140 and the polishing pad 116 that modifies the surface of the polishing pad 116. One example modification results in the surface being scratched, abraded or otherwise substantially uniformly roughened.

In addition, the positioning unit 142 may move the pad conditioning head 140 in a predetermined pattern on the surface of the polishing pad 116. For example, the positioning unit 142 may be a lineal device that selectively moves the pad conditioning head 140 perpendicularly to the rotation of the polishing pad 116 between a first edge 146 and a second edge 148 of the polishing pad 116. Movement of the pad conditioning head 140 may also track and/or take into consideration those areas of the polishing pad 116 where a work piece is being polished. For example, the pad conditioning head 140 may move more slowly or otherwise perform additional conditioning in areas of the polishing pad 116 that are more heavily used during the polishing operation.

The positioning unit 142 may also rotate the pad conditioning head 140. Rotation and/or movement of the pad conditioning head 140 may be performed to minimize inconsistencies in conditioning of the polishing pad 116. In addition, the movement of the polishing pad 116 may allow conditioning of the part of the polishing pad 116 that is used to polish the workpiece.

The pad conditioning head 140 may also be configured to add a liquid, such as water, a pad cleaning solution or a polishing slurry to the polishing pad 116. The liquid may be locally discharged by the pad conditioning head 140 between the pad conditioning head 140 and the polishing pad 116. The flow of liquid may be regulated to minimize excessive heat and frictional wear of the pad conditioning head 140 during the conditioning operation.

The flow of liquid may also be discharged under pressure in a predetermined area. Accordingly, residue generated during the conditioning of the polishing pad 116 may be controlled and/or minimized. In addition, residue that includes by-products, etc. generated from the polishing of a workpiece may be controlled and/or minimized by the flow of liquid between the pad conditioning head 140 and the polishing pad 116. For example, the residue may be directed away from the path of a workpiece being polished with the polishing pad 116.

The localized flow of liquid may also add to the existing slurry and slurry by-products on the polishing pad 116. By adjustment of the flow rate of the liquid, liquid may be discharged by the pad conditioning head 140 to lubricate, cool and clean the polishing pad 116 without adversely affecting the slurry present on the polishing pad 116.

Figure 2:
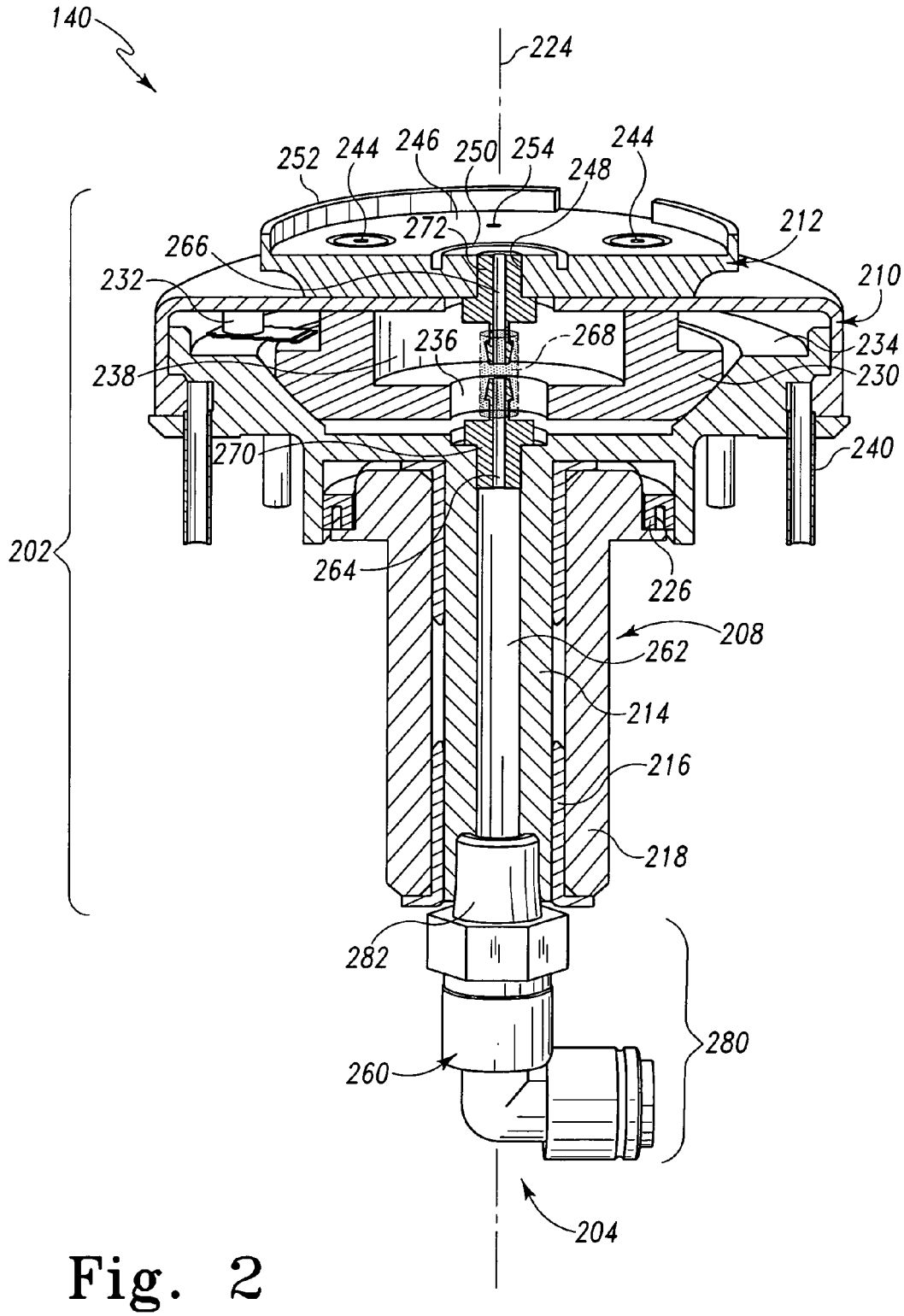
FIG. 2 is a cross section of an example of the pad conditioning head illustrated in FIG. 1.

FIG. 2 is a perspective partial cross-sectional view of an example pad conditioning head 140. The pad conditioning head 140 includes a housing 202 and a liquid supply line 204. As previously discussed, the example pad conditioning head 140 is configured to be mounted below the polishing pad 116 (FIG. 1). The liquid supply line 204 may be configured to extend through the pad conditioning head 140 as illustrated. Alternatively, the liquid supply line 204 may be routed external to the pad conditioning head 140. In other examples, other mounting positions and/or hardware configurations may be used to provide similar functionality.

The illustrated housing 202 includes a neck 208, a chamber 210 and a mounting plate 212. The neck 208 may include a spindle 214 formed to accommodate the liquid supply line 204. In addition, the neck 208 may include a sleeve bearing 216 and a stationary housing 218. In the illustrated example, one end of the spindle 214 may be coupled with, and rotated by, the positioning unit 142 (FIG. 1). The other end of the spindle 214 may be coupled with the chamber 210 to rotate the chamber 210 and the mounting plate 212. The spindle 214 may be rotated concentric with a central axis 224 of the pad conditioning head 140.

The spindle 214 may be formed of plastic, steel or any other rigid material capable of being rotated. The sleeve bearing 216 is positioned to surround the spindle 214 to reduce frictional rotation between the rotating spindle 214 and the stationary housing 218. The sleeve bearing 216 may be stationary during rotation of the spindle 214 and may be formed with a low friction material such as plastic. The stationary housing 218 may be non-rotatably coupled with the positioning unit 142 (FIG. 1) by fasteners, threads or some with coupling mechanism. In other examples, the spindle 214 may be non-rotatable and/or reciprocating.

The neck 208 also includes a gasket 226. The gasket 226 is positioned between the chamber 210 and a portion of the stationary housing 218 and may be formed of rubber, or some other flexible material. The illustrated gasket 226 may be formed in a u-ring to provide a seal between the stationary housing 218 and the rotatable chamber 210. In addition, the gasket 226 may act as a friction-causing member. In other examples, the gasket 226 may be an O-ring or any other form of gasketing material.

The legs of the u-ring shaped gasket 226 may push outward with enough force to provide a seal and still allow for rotation of the chamber 210 with respect to the stationary housing 218. Alternatively, the legs of the gasket 226 may push outward to create sufficient friction to stop rotation of the spindle 214 and chamber 210 during conditioning of the polishing pad 116 (FIG. 1). In this example, the friction created by the legs of the gasket 226 may still allow rotation of the spindle 214 and chamber 210 during other operational conditions such as when the pad conditioning head 140 is not conditioning the polishing pad 116 and is placed in a parked or home position.

The chamber 210 may be formed with a flexible, durable, strong rubber-like material. The chamber 210 enables the mounting plate 212 to be self-centering relative to the remainder of the pad conditioning housing 202. In addition, the flexible material of the chamber 210 prevents the mounting plate 212 from moving too far in any one direction. The illustrated chamber 210 includes a gimbal bearing 230 and a load cell 232. The gimbal bearing 230 and the load cell 232 may be disposed in a cavity 234 formed by the chamber 210.

The gimbal bearing 230 may be fixedly coupled with the spindle 214 and the mounting plate 212 through the chamber 210. The gimbal bearing 230 may be formed of a bearing grade plastic, such as ERTALYTE PET-P, PEEK bearing grade, TEFLON, TURCITE A&X, RULON LR, TORLON 4301, etc. The mounting plate 212 may be allowed to gimbal with respect to the spindle 214 due to the gimbal bearing 230 and the flexibility of the chamber 210. A gimbal point for the mounting plate 212 may be located above the mounting plate 212 external to the pad conditioning head 140. Gimbling of the mounting plate 212 with respect to the gimbal point may maintain a surface 246 of the mounting plate 212 substantially parallel with respect to the polishing pad 116 (FIG. 1) during a conditioning operation.

The gimbal bearing 230 includes a passageway 236 formed to accommodate the liquid supply line 204. The passageway 236 may be formed to be large enough so that the liquid supply line 204 does not bind or kink as the mounting plate 212 is allowed to gimbal. In addition, the gimbal bearing 230 includes a gimbal cavity 238. The gimbal cavity 238 is formed to accommodate hardware associated with the liquid supply line 204 as described later.

The load cell 232 may be any mechanism or device capable of providing an electrical signal indicative of an amount of down force (or deflection) applied to the pad conditioning head 140. More specifically, the gimbal bearing 230 may transfer a downward force to the mounting plate 212 that is applied to the spindle 214 by the positioning unit 142 (FIG. 1). During the conditioning operation, when a down force is applied, the gimbal bearing 230 may move toward the polishing pad 116, while the chamber 210 remains substantially stationary and flexes in response to the down force. The load cell 232 may be calibrated based on the flexibility of the chamber 210 to provide indication of the amount of down force applied.

The chamber 210 may also include a plurality of rotation pins 240. The rotation pins 240 may be dowels or other similar structures that are spaced around the outside of the chamber 210 to guide the circular rotation of the pad conditioning head 140. For example, when the pad conditioning head 140 is away from the polishing pad 116 (FIG. 1), such as in a home or other parked position, the rotation pins 240 may cooperatively operate with a stationary ratchet member (not shown) to guide rotation of the spindle 214 and mounting plate 212.

The mounting plate 212 can be formed of any rigid material such as stainless steel. The illustrated mounting plate 212 is coupled through the chamber 210 with the gimbal bearing 230 by fasteners 244 that are flat head screws. The fasteners 244 penetrate the surface 246 of the mounting plate 212 through apertures in the upper surface 246. In other examples, welding, gluing or any other type of fasteners may be used. The mounting plate 212 also includes at least one liquid supply aperture 248 that penetrates through the upper surface 246 of the mounting plate 212.

The liquid supply aperture 248 may be formed concentric with the central axis 224 to accommodate a portion of the liquid supply line 204. Alternatively, a plurality of liquid supply apertures 248 may be formed in the mounting plate 212 to accommodate a plurality of liquid supply lines 204.

Also formed in the mounting plate 212 is a groove 250, a collar 252 and a mounting aperture 254. The groove 250 may be formed in the surface 246 concentric with the central axis 224. The collar 252 may concentrically surround and extend perpendicular to the surface 246. The mounting aperture 254 may be a threaded aperture formed in the surface 246 with a determined depth. The surface 246, the groove 250 and the collar 252 may be formed to accommodate a conditioning element.

Figure 3:
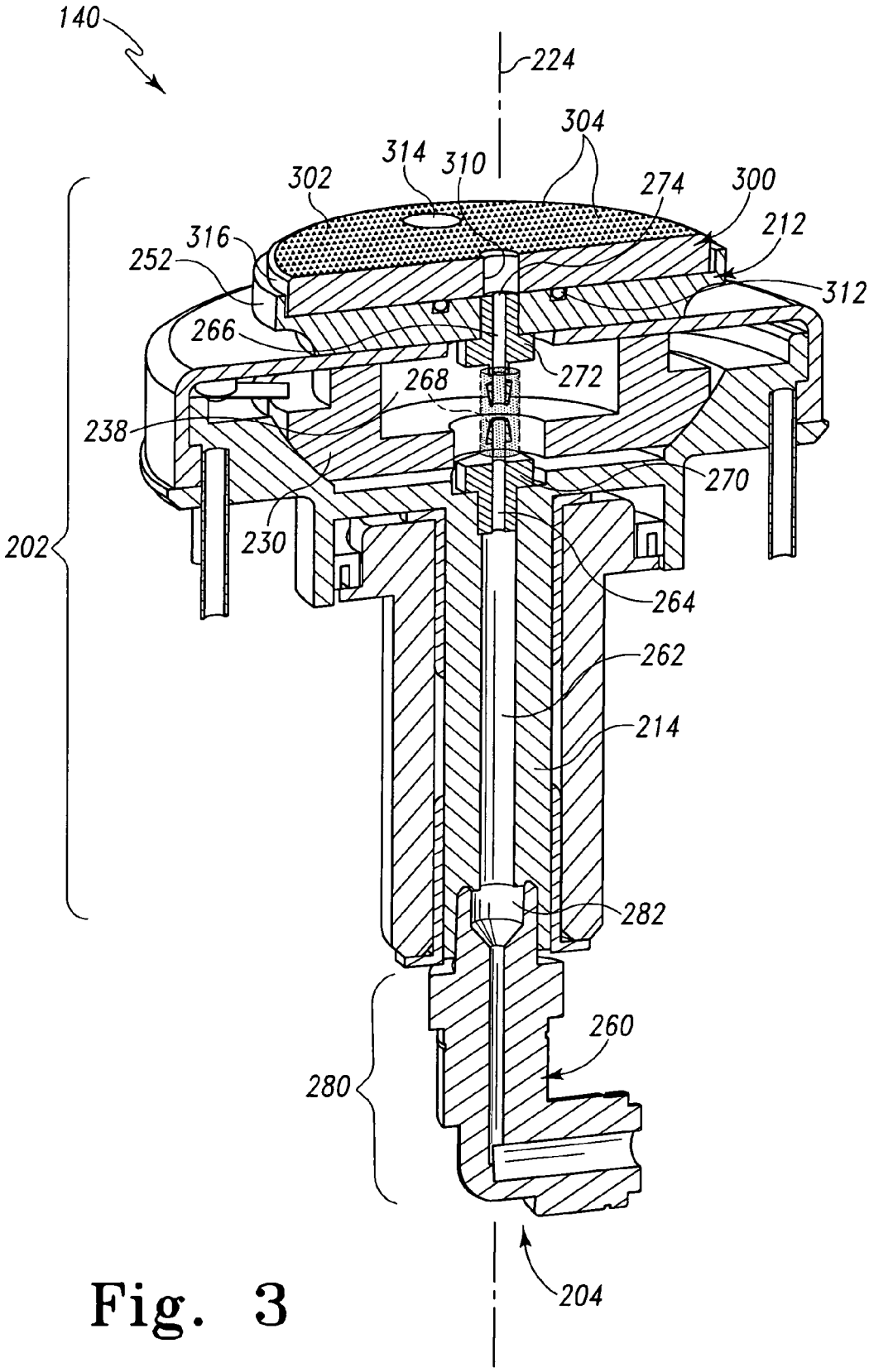
FIG. 3 is a cross section of another example of the pad conditioning head illustrated in FIG. 1.

FIG. 3 is a perspective view of the example housing 202 of the pad conditioning head 140 illustrated in FIG. 2. The illustrated pad conditioning head 140 also includes a conditioning element 300. The conditioning element 300 may be a circular shaped disc, a crescent shape plate, a spherical shaped object or any other shape and/or object capable of being brought into contact with a polishing pad 116 (FIG. 1). In the illustrated example, the conditioning element 300 is a circular disc of a predetermined diameter, such as about two inches that is formed to fit on the surface 246 (FIG. 2) of the mounting plate 212.

The conditioning element 300 may be formed of stainless steel or other similar rigid material and includes a conditioning surface 302 formed to be pressed into the polishing pad 116 (FIG. 1). A plurality of abrasive particles 304 may be adhered to the surface 302 and protrude outwardly from the surface 302. The abrasive may be formed with different materials and have different orientations on the surface 302. For example, the abrasive particles 304 may be different types of diamond particles, such as blocky, cubic octahedral, angular and mosaic diamonds that may be oriented face up, edge up or in a mixed pattern.

The abrasive particles 304 may be brazed to the surface 302 and fully or partially coated by a finish coat applied by physical vapor deposition (PVD), chemical vapor deposition (CVD) or some other process of laying down a coating. The abrasive particles 304 may form a grit capable of scratching the polishing pad 116 (FIG. 1). In one example, the surface 302 is substantially flat, and the majority of the abrasive particles 304 may extend above the surface 302. In another example, the surface 302 may be dome shaped with the majority of the abrasive particles 304 extending outwardly from the hemispherical shaped surface 302.

The conditioning element 300 also includes a conditioning aperture 310, a rib 312 and a mounting aperture 314 to allow the conditioning element to be detachably coupled with the mounting plate 212. The conditioning aperture 310 may be formed to accommodate a portion of the liquid supply line 204 when the conditioning element 300 is mounted on the mounting plate 212. The rib 312 may be formed to fit within the groove 250 in the surface 246 (FIG. 2) of the mounting plate 212. An outer edge 316 of the conditioning element 300 may be formed to fit within the collar 252 of the mounting plate 212.

The mounting aperture 314 may be formed to accommodate a fastener such as a threaded flat head screw. The fastener may penetrate through the conditioning element 300 and be coupled with the mounting aperture 254 in the surface 246 (FIG. 2) of the mounting plate 212. Thus, the conditioning element 300 may be securely coupled with the mounting plate 212. Alternatively or in addition, the mounting plate 212 may be formed of a material capable of maintaining a magnetic charge and the conditioning element 300 may be attractive to a magnetic charge. Any one or more of the described coupling mechanisms may be employed to detachable couple the conditioning element 300 to the mounting plate 212. Since the conditioning element 300 is mounted on the mounting plate 212, the conditioning element 300 may gimbal with the mounting plate 212 so that the surface 302 remains substantially parallel with the polishing pad 116 (FIG. 1) during a conditioning operation.

Referring to FIGS. 2 and 3, the liquid supply line 204 includes a rotary union 260, a rotating tube 262, a first flange 264, a second flange 266, a gimbal coupler 268, a first flange keeper 270, a second flange keeper 272 and a nozzle 274. The rotary union 260 may be any form of fitting capable of rotatably coupling a liquid source (not shown) to the pad conditioning head 140. The liquid source may be any mechanism(s) or device(s) capable of providing one or more pressurized liquids.

As best illustrated in FIG. 3, the rotary union 260 includes a first non-rotatable section 280 and a second rotatable section 282. One example rotary union 260 is manufactured by Rotary Systems, Inc. of Anoka, Minn. The non-rotatable section 280 is configured to accept a hose or tube from the liquid source and provide a passageway for liquid to the rotating section 282. The rotating section 282 is configured to be fixedly coupled with the rotating tube 262 and provide a flow path for liquid to the rotating tube 262. One end of the rotating tube 262 is fixedly coupled with the rotatable section 282 of the rotary union 260 with a liquid tight connection by gluing, welding, friction fit or any other coupling mechanism.

The rotating tube 262 is disposed within the rotatable spindle 214. Accordingly, as the spindle 214 rotates, the rotating tube 262 and the rotatable section 282 of the rotary union 260 all rotate together. The non-rotatable section 280 of the rotary union 260 may remain stationary. The rotating tube 262 may be any form of duct and/or passageway configured to allow a flow of liquid therethrough. One end of the first flange 264 may be fixedly coupled with the end of the rotating tube 262 opposite the rotating section 282 by welding, gluing, friction fit, and/or any other form of liquid tight connection.

The first flange keeper 270 may be coupled with the first flange 264 and the spindle 214 to maintain the relative position of the first flange 264. The end of the first flange 264 opposite the rotating tube 262 may be coupled with the gimbal coupler 268. In addition, one end of the second flange 266 may be coupled with the gimbal coupler 268. The gimbal coupler 268 may be a non-rigid duct that provides a flexible liquid tight passageway between the first and second flanges 264 and 266. As the mounting plate 212 and the conditioning element 300 gimbal, the gimbal coupler 268 may flex to eliminate strain on the first and second flanges 264 and 266.

The second flange keeper 272 may be coupled with the second flange 266 and the mounting plate 212 to maintain the relative position of the second flange 266 in the liquid supply aperture 248. The end of the second flange 266 opposite the gimbal coupler 268 may form the nozzle 274. Alternatively, the nozzle 274 may be a separate device coupled with the second flange 266. The nozzle 274 may be disposed in the conditioning aperture 310. Liquid flowing through the liquid supply line 204 may be discharged from the nozzle 274 into the conditioning aperture 310.

The flow rate of the liquid may be controlled with flow control equipment, such as a flow meter and a control valve (not shown). Determination of the flow rate may be based on what maintains a desirable liquid level on the polishing pad 116. In other words, the flow rate may be maintained at a rate that does not wash away slurry that is still useful in the planarization operation. In addition, the flow rate may be at a rate that maximizes the life of the abrasive particles 304. The flow of liquid may also be continuous or intermittent. For example, liquid may be applied at only the beginning, or only the end of a conditioning operation. Similarly, the flow rate may be dynamically varied at different stages of conditioning, such as one flow rate for a first determined time and a second flow rate for a second determined time. In addition, the flow rate may be dynamically varied based on the position of the pad conditioning head 140 on the surface of the polishing pad 116 (FIG. 1), such as a lower flow rate near the first and second edges 146 and 148 and a higher flow rate near the middle of the polishing pad 116 (FIG. 1).

During a conditioning operation, the liquid may be discharged by the nozzle 274 to spray and/or flow onto the abrasive particles 304. In addition, the liquid may spray and/or flow out onto the surface 302 of the conditioning element 300 and onto the polishing pad 116 (FIG. 1) as the surface of the polishing pad 116 is conditioned. Since the nozzle 274 is discharging liquid at substantially the center of the conditioning element 300, the liquid is applied in a controlled manner between the conditioning element 300 and the area of the polishing pad 116 that is being conditioned. Accordingly, desirable by products from the polishing operation, such as slurry, may be managed and remain on the polishing pad 116. In addition, by products from the conditioning and polishing operations, such as residue may be directed and/or rinsed away from the abrasive particles 304 by the discharge of liquid. The liquid may also act as a lubricant to minimize friction related wear of the abrasive particles 304 on the surface 302 of the conditioning element 300.

As previously discussed, the pad conditioning head 142 operates to condition the polishing pad 116 (FIG. 1). By scratching the polishing pad 116, undesirable planarization (or smoothing) of the polishing pad 116 is avoided. Avoiding planarization of the polishing pad 116 may minimize shifts in processing performance when multiple work pieces are sequentially planarized. The addition of a liquid such as water, to the conditioning element 300 may be analogous to wet sanding. The liquid may help to minimize residue and maintain the polishing pad 116 in a cleaner condition by pushing residue and other undesirable materials out of the processing path and/or off of the polishing pad 116 (FIG. 1). In addition, the liquid may push the slurry and other abrasive elements away from the abrasive particles 304 on the conditioning element 300 to minimize wear of the abrasive particles 304.

The pad conditioning head 142 may also condition and apply liquid in determined areas of the polishing pad 116 instead of spraying liquid over larger areas of the polishing pad 116. Further, introduction of liquid during the conditioning process may minimize undesirable temperature rise in the polishing pad 116 and/or the conditioning element 300. Accordingly, specific areas of the polishing pad 116 that are subject to conditioning may also be subject to cleaning, lubrication and cooling.

As should be recognized, the rotating and non-rotating sections 280 and 282 of the rotary union 260 are not necessary when the pad conditioning head 140 does not rotate. In addition, the gimbal coupler 268 may be enlarged and/or modified appropriately when the mounting plate 212 and the conditioning element 300 are capable of reciprocating movement during conditioning of the polishing pad 116 (FIG. 1).

Figure 4:
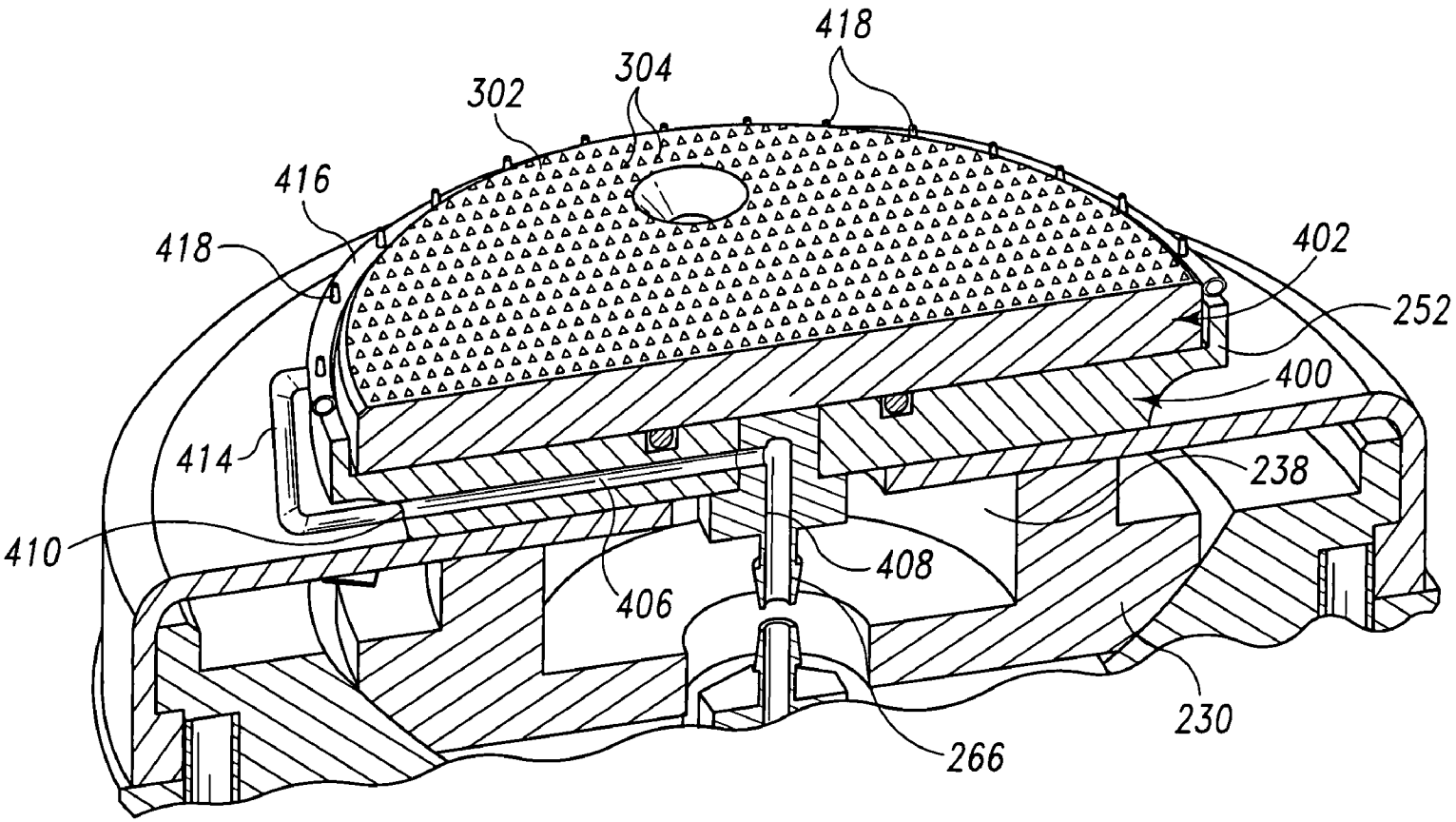
FIG. 4 is a cross section of a portion of yet another example of the pad conditioning head illustrated in FIG. 1.

FIG. 4 is a partially cross-sectioned perspective view of another example of a portion of the pad conditioning head 140 that includes the mounting plate 400 and the conditioning element 402. The mounting plate 400 includes an internal passageway 406. A first aperture 408 of the internal passageway 406 is configured to form a liquid tight connection with the second flange 266 within the liquid supply aperture 248 of the mounting plate 400. A second aperture 410 forms the opposite end of the internal passageway 406 and is disposed in an outer wall of the mounting plate 400. One end of a flexible hose 414 may be coupled by a liquid tight connection to the second aperture 410. Connection with the first and second apertures 408 and 410 may be by threaded connection, welding, glue or any other coupling mechanism.

The flexible hose 414 may be similarly coupled at an opposite end with a manifold 416. The manifold 416 may form a hollow passageway for the flow of liquid. At least one nozzle 418 may be formed in the manifold 416 to provide a flow of liquid out of the manifold 416. Alternatively, one or more external nozzles 418 may be coupled with the manifold 418 to provide a flow of liquid out of the manifold 418.

In the illustrated example, the manifold 416 is fixedly coupled with the collar 252 and at least partially surrounds the conditioning element 402. The manifold 416 and/or the nozzles 418 may be positioned such that liquid discharged from the nozzles 418 is directed on to the surface 302 of the conditioning element 402. In the illustrated example, the nozzles 418 are oriented so that liquid may be discharged onto the polishing pad 116 (FIG. 1). In this configuration, the pad conditioning head 142 may move over the portion of the polishing pad 116 that has just been sprayed. Accordingly, the liquid is discharged between the polishing pad 116 and the pad conditioning head 142. In other examples, the nozzles 418 may be oriented so that the liquid is discharged towards the point of contact between the pad conditioning head 142 and the polishing pad 116, or any other orientation that discharges the liquid between the pad conditioning head 142 and the polishing pad 116.

The discharged liquid may be advantageously discharged between the surface 302 of the conditioning element 402 and the surface area of the polishing pad 116 (FIG. 1) being conditioning. The liquid may provide localized rinsing/cleaning and lubrication to minimize residue, and minimize excessive wear of the abrasive particles 304. In addition, the liquid may reduce localized heating between the conditioning element 402 and the polishing pad 116 (FIG. 1).

Figure 5:
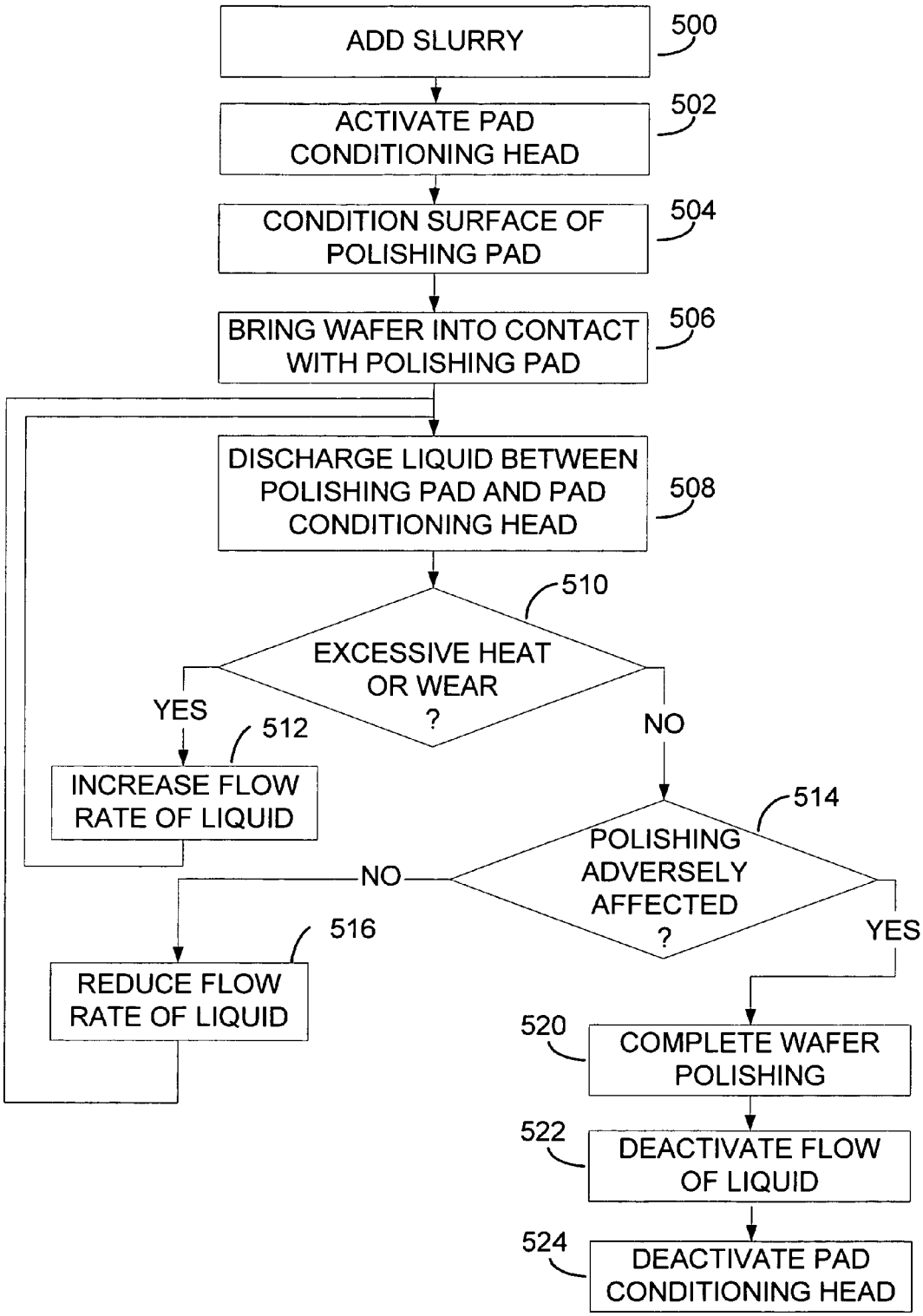
FIG. 5 is an example operational flow diagram for the chemical planarization machine illustrated in FIG. 1.

FIG. 5 is a flow diagram illustrating example operation of the pad conditioning system 100 with reference to FIGS. 1–4 during polishing of a semiconductor wafer 114. The operation begins at block 500 when slurry from the slurry dispenser 130 is added to the polishing pad 116. At block 502, the pad conditioning head 140 is activated and moved into contact with the rotating polishing pad 116. The pad conditioning head 140 is activated to rotate and down force is applied by the positioning unit 142 to roughen the surface of the polishing pad 116 at block 504. At block 506, the wafer 114 mounted on the wafer carrier 112 is brought into contact with the rotating polishing pad 116.

The flow of liquid is activated to flow through the liquid supply line 204 at block 508. As previously discussed, the flow of liquid may be continuous or intermittent. At block 510, it is determined if there is excessive heating between the conditioning element 300, 400 and the polishing pad 116, and/or excessive wearing of the abrasive particles 304 on the surface 302 of the conditioning element 300, 400. If there is excessive heat and/or wear, the flow rate of the liquid is increased at block 512, and the operation returns to block 508.

If there is not excessive heat and/or wear at block 510, it is determined if the polishing operation is being adversely affected, such as the slurry is being undesirably diluted and/or washed away, by the flow of liquid at block 514. If the polishing operation is being adversely affected, the flow rate of the liquid is reduced at block 516 and the operation returns to block 508. If the polishing operation is not being adversely affected, the operation completes the wafer polishing and the wafer 114 is removed from contact with the polishing pad 116 at block 520. At block 522, the flow of liquid to the pad conditioning head 140 is deactivated. The pad conditioning head 140 is deactivated and removed from contact with the polishing pad 116 at block 524 until another wafer polishing operation commences.

It is therefore intended that the foregoing detailed description be regarded as illustrative rather than limiting, and that it be understood that it is the following claims, including all equivalents, that are intended to define the spirit and scope of this invention.

What is claimed is:

1. A pad conditioning system for conditioning a polishing pad in conjunction with a workpiece polishing operation, the pad conditioning system comprising:

a pad conditioning head having a plurality of abrasive particles protruding from a surface of the pad conditioning head;

a positioning unit coupled with the pad conditioning head, wherein the positioning unit is configured to move the surface into contact with a polishing pad;

a liquid supply nozzle configured to selectively discharge liquid onto the abrasive particles that are in contact with the polishing pad to minimize frictional wear of the abrasive particles;

and a liquid supply line that extends through the pad conditioning head and is configured to supply liquid to the liquid supply nozzle, wherein the surface is configured to gimbal with respect to the pad conditioning head and the liquid supply line includes a gimbal coupler that forms a portion of the liquid supply line, wherein the gimbal coupler is configured to flex to relieve stress on the liquid supply line as the surface gimbals.

2. The pad conditioning system of claim 1, wherein the pad conditioning head includes an aperture formed in the surface that is positionable contiguous with the polishing pad, the liquid supply nozzle disposed in the aperture.

3. The pad conditioning system of claim 1, further comprising a manifold mounted on the pad conditioning head adjacent to the surface, the manifold comprising the liquid supply nozzle.

4. The pad conditioning system of claim 1, wherein the pad conditioning head comprises a conditioning element that is substantially disc shaped and the surface is formed on the conditioning element.

5. The pad conditioning system of claim 4, wherein the surface is a flat surface.

6. The pad conditioning system of claim 4, wherein the surface is a domed surface.

7. The pad conditioning system of claim 1, wherein the positioning unit is configured to move the pad conditioning head into contact with the polishing pad with sufficient down force to roughen the polishing pad.

8. The pad conditioning system of claim 1, wherein the abrasive particles comprise diamonds and the liquid is water.

9. The pad conditioning system of claim 1, wherein the positioning unit is configured to maintain contact between the pad conditioning head and the polishing pad and selectively move the pad conditioning head in a predetermined pattern on the surface of the polishing pad.

10. The pad conditioning system of claim 1, wherein the liquid supply nozzle is configured to discharge liquid between the polishing pad and the surface of the pad conditioning head.

11. The pad conditioning system of claim 1, wherein the pad conditioning head comprises a conditioning element on which the surface is formed, the conditioning element configured to gimbal with respect to the pad conditioning head, and the liquid supply line includes a gimbal coupler forming a portion of the liquid supply line, wherein the gimbal coupler is configured to flex to relieve stress on the liquid supply line as the conditioning element gimbals.

12. The pad conditioning system of claim 11, wherein the liquid supply line includes a first flange coupled with the pad conditioning head and a second flange coupled with the conditioning element, and the gimbal coupler is coupled between the first flange and the second flange so that the first flange, the gimbal coupler and the second flange form a passageway for the flow of liquid.

13. A pad conditioning system for conditioning a polishing pad in conjunction with a workpiece polishing operation, the pad conditioning system comprising:

a liquid supply nozzle configured to discharge liquid in a predetermined area;

a pad conditioning head positionable proximate to the liquid supply nozzle, the pad conditioning head comprising a conditioning element upon which a plurality of abrasive particles are disposed, wherein the conditioning element is configured to be pressed into and moved in a determined pattern around a surface of a polishing pad to roughen the surface of the polishing pad with the abrasive particles, wherein the liquid supply nozzle is configured to discharge liquid between the conditioning element and the polishing pad;

and a liquid supply line coupled with the liquid supply nozzle, wherein the conditioning element is configured to gimbal and the liquid supply line includes a gimbal coupling to relieve stress on the liquid supply line when the conditioning element gimbals.

14. The pad conditioning system of claim 13, wherein the liquid supply nozzle is coupled at the periphery or the conditioning element.

15. The pad conditioning system of claim 13, wherein the conditioning element includes an aperture formed on the conditioning element between the abrasive particles, the liquid supply nozzle disposed in the aperture.

16. The pad conditioning system of claim 15, wherein the liquid supply nozzle is a plurality of liquid supply nozzles and the aperture is a plurality of apertures distributed around the abrasive particles and each of the liquid supply nozzles is disposed in one of the apertures so that liquid may be selectively discharged from the liquid supply nozzles to minimize wear of the abrasive panicles.

17. The pad conditioning system of claim 13, wherein the conditioning element is configured to rotate while being pressed into the polishing pad, and the pad conditioning head includes a rotary union coupled with a liquid supply line and the liquid supply nozzle so that the liquid supply nozzle is rotatable with the conditioning element.

18. The pad conditioning system of claim 13, wherein a surface of the conditioning element that includes the abrasive particles is flat.

19. The pad conditioning system of claim 13, wherein a surface of the conditioning element that includes the abrasive particles is domed.

20. The pad conditioning system of claim 13, wherein the flow rate of liquid discharged by the liquid supply nozzle is configurable to lubricate, cool and remove residue from the polishing pad without adverse affect on a liquid slurry present on the polishing pad.

21. The pad conditioning system of claim 13, wherein the liquid supply nozzle is in a manifold, and the pad conditioning head comprises a mounting plate upon which the conditioning element is mounted, the manifold is also mounted on the mounting plate.

22. A method of conditioning a polishing pad in conjunction with a workpiece polishing operation, the method comprising:

pressing a conditioning element included in a pad conditioning head into a polishing pad to condition the polishing pad, wherein a surface of the conditioning element includes a plurality of abrasive particles extending outward from the surface;

gimbaling the conditioning element with respect to the pad conditioning head to maintain the surface substantially parallel with the polishing pad;

supplying a liquid through a liquid supply line that includes a first member coupled with the pad conditioning head and a second member coupled with the conditioning element;

selectively discharging the liquid between the abrasive particles and the polishing pad only in the area being conditioned; and flexing a gimbal coupler that couples the first member to the second member to relieve stress on the liquid supply line as the conditioning element gimbals.

23. The method of claim 22, wherein selectively discharging liquid comprises minimizing the residue developed when the polishing pad is conditioned.

24. The method or claim 22, wherein selectively discharging liquid comprises minimizing the heat developed when the polishing pad is conditioned.

25. The method of claim 22, wherein selectively discharging liquid comprises discharging liquid from an aperture formed substantially in the center of the surface of the pad conditioning head.

26. The method of claim 22, wherein selectively discharging liquid comprises discharging liquid from a liquid supply nozzle coupled at a peripheral edge of the surface of the pad conditioning head.

27. The method of claim 22, wherein selectively discharging liquid comprises directing residue on the polishing pad away from the path of the workpiece being polished, wherein the residue is being directed with the discharged liquid.

28. The method of claim 22, wherein selectively discharging liquid comprises rinsing residue away from the abrasive particles, wherein the residue is being rinsed away with the discharged liquid.

* * * * *